US010045578B2

(12) United States Patent
Kovatch

(10) Patent No.: US 10,045,578 B2
(45) Date of Patent: Aug. 14, 2018

(54) BRASSIERE WITH STORAGE FASTENER

(71) Applicant: Under Armour, Inc., Baltimore, MD (US)

(72) Inventor: Jaclynn Kovatch, Baltimore, MD (US)

(73) Assignee: UNDER ARMOUR, INC., Baltimore, MD (US)

( * ) Notice: Subject to any disclaimer, the term of this patent is extended or adjusted under 35 U.S.C. 154(b) by 0 days.

(21) Appl. No.: 15/396,458

(22) Filed: Dec. 31, 2016

(65) Prior Publication Data

US 2018/0184740 A1 Jul. 5, 2018

(51) Int. Cl.
*A41F 15/00* (2006.01)
*A41C 3/00* (2006.01)

(52) U.S. Cl.
CPC ..... *A41F 15/00* (2013.01); *A41C 3/0057* (2013.01)

(58) Field of Classification Search
CPC ..... A41F 15/00; A41C 3/0057; A41C 3/00
USPC ..... 450/86; 2/114, 115, 113, 69, 105, 106, 2/104
See application file for complete search history.

(56) References Cited

U.S. PATENT DOCUMENTS 1,510,388 A * 9/1924 Darling ..... A41F 15/02 2/268
1,631,694 A * 6/1927 Rick ..... A45F 3/12 2/460
2,505,272 A * 4/1950 Blalock ..... A41F 15/007 2/336
6,146,239 A * 11/2000 Magliocchetti ..... A41F 19/005 450/1
7,028,342 B1 * 4/2006 Nordstrom ..... A41D 1/04 2/119
8,961,263 B2 * 2/2015 Magliocchetti ..... A41F 19/005 2/105
9,549,575 B2 * 1/2017 Magliocchetti ..... A41F 19/005

* cited by examiner

*Primary Examiner* — Gloria Hale
(74) *Attorney, Agent, or Firm* — Edell, Shapiro & Finnan, LLC

(57) ABSTRACT

A brassiere disclosed herein includes at least one cup, at least one strap extending from the cup, and a strip of material or fastener attached to the interior surface of the at least one strap. The fastener may be coupled to the interior surface of the at least one strap at each of the ends of the fastener. Thus, the fastener, together with the at least one strap, may be manipulated to form an opening through which items may be placed or threaded. Furthermore, the at least one strap and the fastener may be constructed from a resilient material.

18 Claims, 5 Drawing Sheets

BRASSIERE WITH STORAGE FASTENER

FIELD OF THE INVENTION

The present invention relates to an article of clothing or garment. More specifically, the present invention relates to brassiere that contains a fastener for storing or securing items.

BACKGROUND OF THE INVENTION

Women often use sports brassieres, or sports bras, for workouts and other athletic activities (e.g., team sports, running, cycling, etc.). Other articles of clothing worn by women during workouts, however, are often tight and form fitting, and may not include pockets to store or secure items. Thus, it would be desirable to provide a sports bra that is equipped with a fastener to secure or store items before, during, and after athletic activities. It would be further desirable to a sports bra equipped with a fastener that enables quick and easy access to these stored items.

In addition, women often utilize headphones to listen to music or other audio while performing the athletic activities. Headphone cords, however, are often in the way of the user performing the athletic activities. The cord of the headphones may often grab or be caught by items being used during athletic activities, or by the body parts of the user performing athletic activities (e.g., the arms of the user). Therefore, it would be desirable to provide an article of clothing, or sports bra, that is equipped with a fastener that secures the headphone cords close to the body of the user wearing the article of clothing so that the headphone cord is out of the way of the user performing the athletic activities. This may not only prevent the risk of injury to the athlete wearing the sports bra, but may also prevent damage to either the cord or the device in which the cord is connected.

BRIEF SUMMARY OF THE INVENTION

A brassiere, as disclosed herein, includes at least one cup, at least one strap extending from the cup, and a strip of material or fastener attached to the interior surface of the at least one strap. The fastener may be coupled to the interior surface of the at least one strap at each of the ends of the fastener. Thus, the fastener, together with the at least one strap, may be manipulated to form an opening through which items may be placed or threaded. Furthermore, the at least one strap and the fastener may be constructed from a resilient material. The resiliency of the at least one strap and the fastener are configured to impart compression forces that both secure items against the interior surface of the at least one strap and secure items against the body of the user wearing the brassiere. The brassiere described herein enables women wearing the brassiere to secure or store items during athletic activities, while also providing quick and easy access to these stored items during the athletic activities.

BRIEF DESCRIPTION OF THE SEVERAL VIEWS OF THE DRAWINGS

Like reference numerals have been used to identify like elements throughout this disclosure.

DETAILED DESCRIPTION OF THE INVENTION

Figure 1:
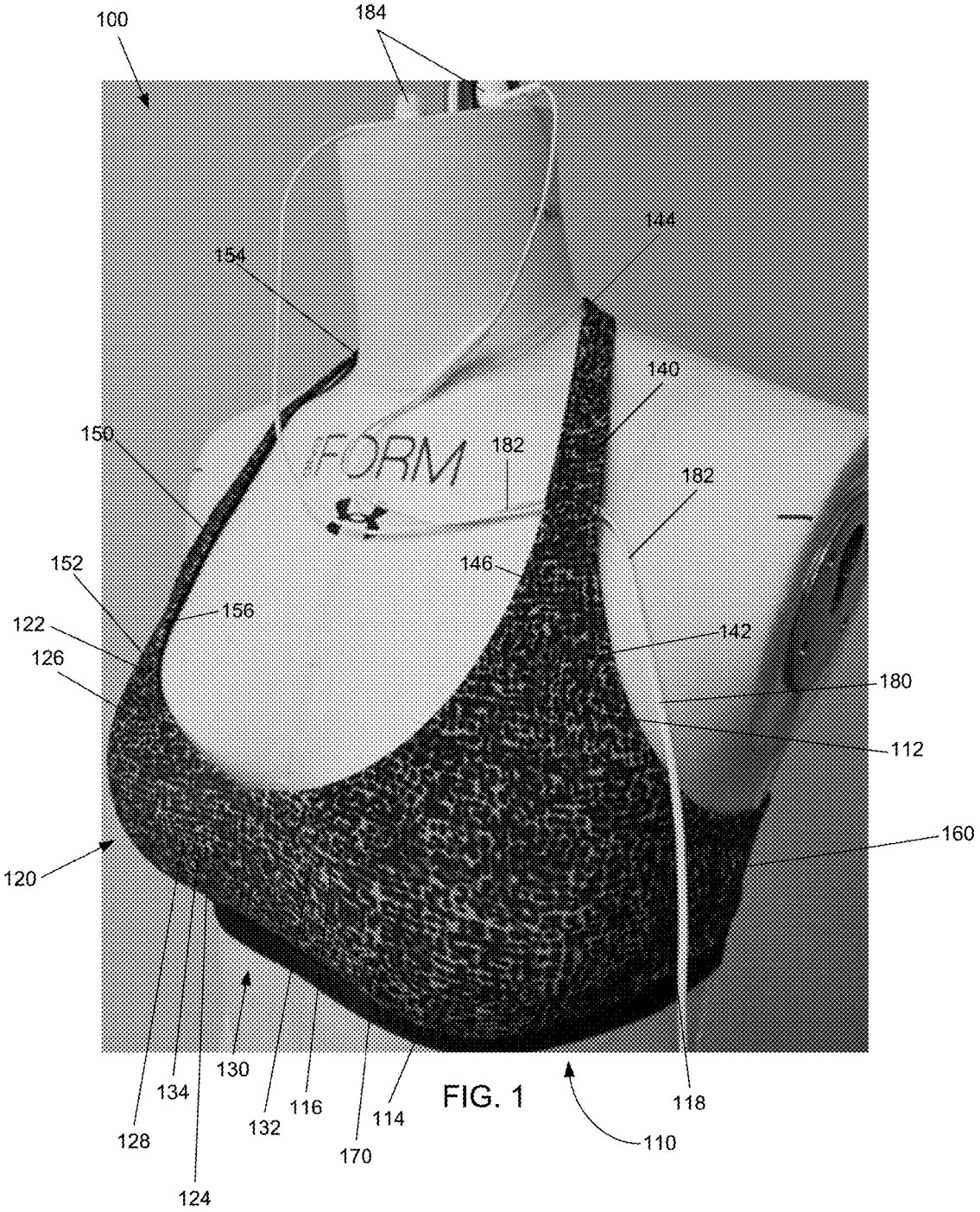
FIG. 1 illustrates a perspective view of a brassiere in accordance with an embodiment of the present invention.

Referring to FIGS. 1-5, illustrated is an embodiment of a brassiere 100 that can be worn by a person. While the brassiere 100 illustrated in FIGS. 1-5 is a sports bra, the invention disclosed herein may be utilized in any type of brassiere. The brassiere 100 contains a first cup 110, a second cup 120, a bridge 130 connecting the first cup 110 to the second cup 120, a first strap 140 extending substantially upwardly from the first cup 110, and a second strap 150 extending substantially upwardly from the second cup 120. As illustrated, the brassiere 100 may further includes a wing 160 that extends around the back of the user wearing the brassiere 100 to connect the first cup 110 and the second cup 120 around the back of the user wearing the brassiere 100, and a band 170 that extends around or encompasses the torso of a user wearing the brassiere 100.

The first cup 110 has a top side 112, a bottom side 114 opposite the top side 112, a first side 116, and a second side 118 opposite the first side 116. Similarly, the second cup 120 has a top side 122, a bottom side 124 opposite the top side 122, a first side 126, and a second side 128 opposite the first side 126. Thus, the first cup 110 and the second cup 120 may be substantially similar to one another, and may be mirror images of one another. The bridge 130 includes a first end 132 and the second end 134 opposite the first end 132. As illustrated, the first end 132 of the bridge 130 is coupled to, and uniformly formed with, the first end 116 of the first cup 110, while the second end 134 of the bridge 130 is coupled to, and uniformly formed with, the second end 128 of the second cup 120. Thus, the bridge 130 connects the first cup 110 and the second cup 120 across the chest or breast of the user wearing the brassiere 100. More specifically, when worn, the bridge 130 may be disposed proximate to the sternum of a user wearing the brassiere 100, while the first cup 110 may receive a first breast of the user and the second cup 120 that receives a second breast of the user.

As previously noted, the first strap 140 extends substantially upward from the first cup 110, while the second strap 150 extends substantially upward from the second cup 120. The first strap 140 is elongated and includes a first end 142 and a second end 144. The first end 142 of the first strap 140 may be coupled to, and uniformly formed with, the top side 112 of the first cup 110. The second strap 150 is also elongated and also includes a first end 152 and a second end 154. Similar to the first strap 140, the first end 152 of the second strap 150 may be coupled to, and uniformly formed with, the top side 122 of the second cup 120. When the brassiere 100 is worn by a user, both the first strap 140 and the second strap 150 extend upward from the first and second cups 110, 120, respectively, such that the first and second straps 140, 150 wrap around the back of the neck of the user wearing the brassiere 100. Thus, the second end 144 of the first strap 140 and the second end 154 of the second strap 150 are disposed proximate to the backside of the neck of a user wearing the brassiere 100. The second end 144 of the first strap 140 may be coupled to the second end 154 of the second strap 150. In another embodiment, the first and second straps 140, 150 may form a singular strap that is coupled to both the first and second cups 110, 120 and extends upwardly around the back of the neck of the user wearing the brassiere 100.

The brassiere 100 further includes a wing 160 and a band 170. Wing 160 may be coupled to the second side 118 of the first cup 110 and the first side 126 of the second cup 120 (not illustrated). When the brassiere 100 is worn by a user, the wing 160 extends from the first cup 110 to the second cup 120 around the back of the user. Band 170 may be configured to wrap around and encompass the torso of the user wearing the brassiere 100. Band 170 may be coupled to the bottom side 114 of the first cup 110 and the bottom side 124 of the second cup 120, as well as the bridge 130 and the wing 160. Band 170 may be more resilient than the other portions of the brassiere 100 to impart a compression force on the portion of the torso the band 170 encompasses to enable the brassiere 100 to remain in place. This resilient or compression force further enables the brassiere 100 to provide proper support to the user wearing the brassiere 100.

Figure 2:
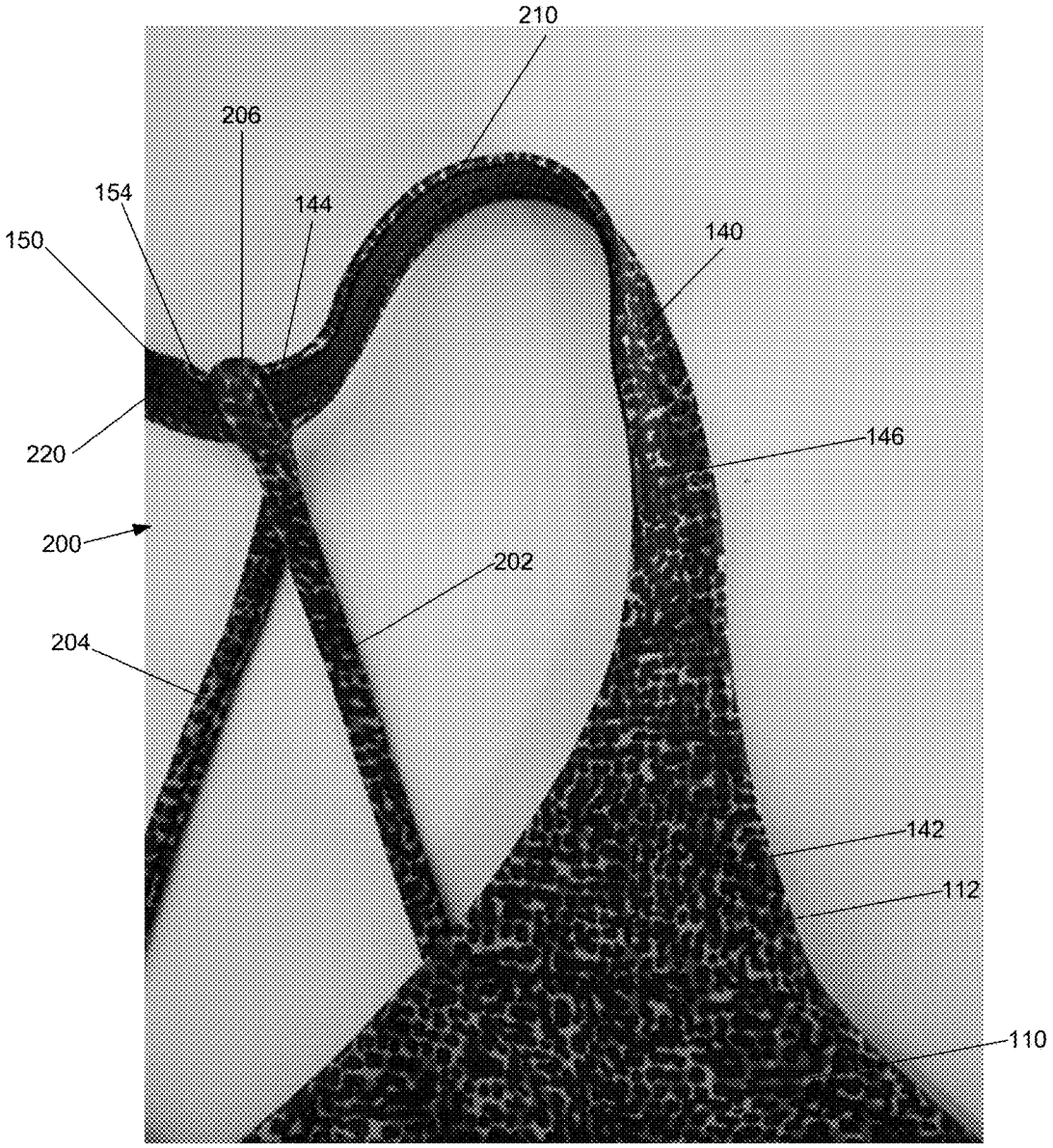
FIG. 2 illustrates a front view of one of the straps of the embodiment of the brassiere illustrated in FIG. 1, the front view showing the exterior surface of the strap.
Figure 3:
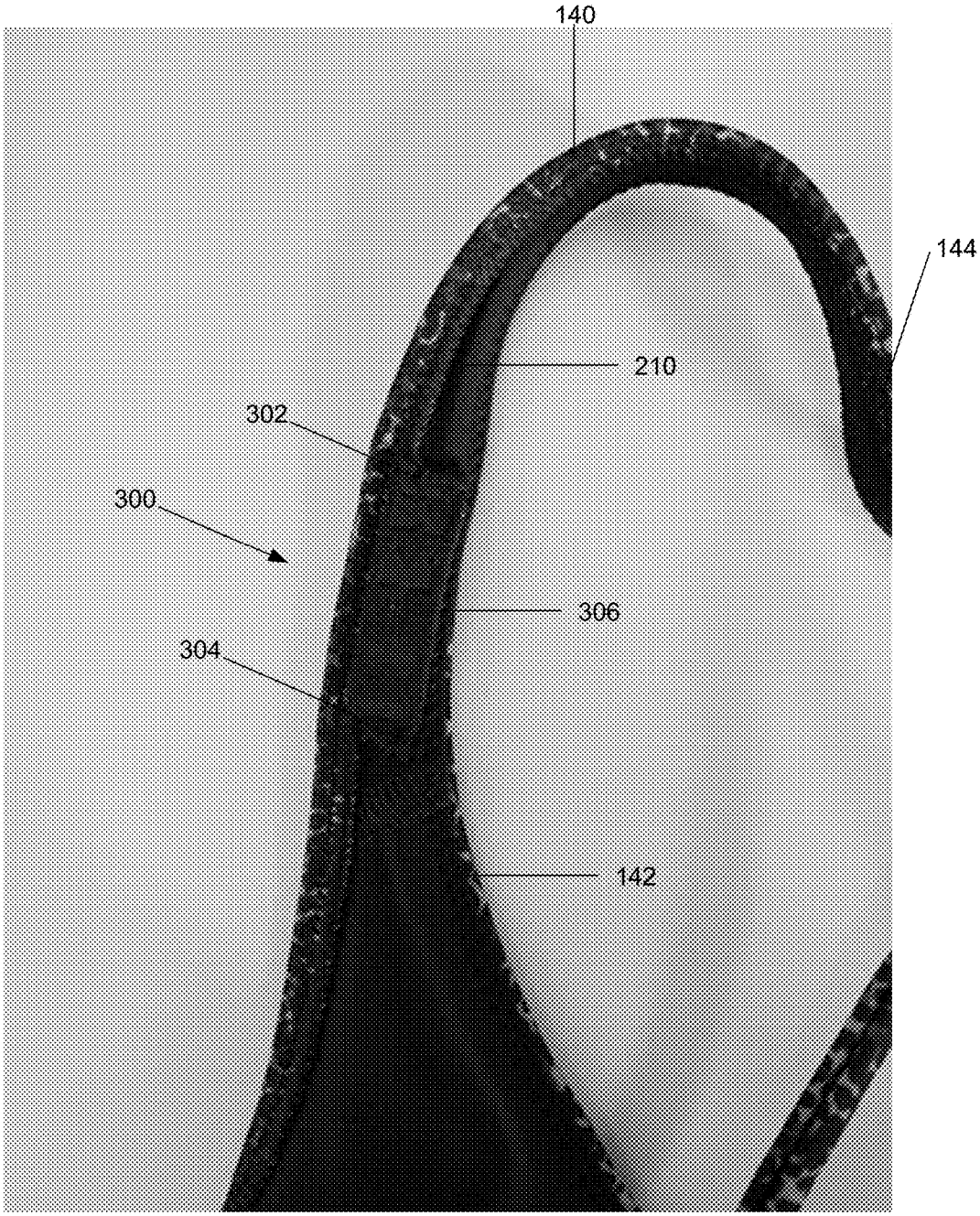
FIG. 3 illustrates a rear view of one of the straps of the embodiment of the brassiere illustrated in FIG. 1, the rear view showing the interior surface of the strap.

As best illustrated in FIG. 2, the brassiere 100 also includes a rear strap 200. The rear strap 200 may be located along the back of the user wearing the brassiere 100. As illustrated, the rear strap 200 may include a first segment 202 and a second segment 204. While not shown, the first and second segments 202, 204 may be coupled to a portion of the wing 160 that is disposed along the back of the user when wearing the brassiere 100. Thus, the rear strap 200 is located adjacent to the back of the user when wearing the brassiere 100. The rear strap 200 may further include a loop 206 that is coupled to the first and second segments 202, 204. The loop 206 may be configured to wrap around the connection of the second end 144 of the first strap 140 to the second end 154 of the second strap 150. In other words, the second end 144 of the first strap 140 is coupled to the second end 154 of the second strap 150, and the connection of the first and second straps 140, 150 is threaded through the loop 206. The loop 206 of the rear strap 200 may also be configured to slide along the first and second straps 140, 150 to position the rear strap 200 in a desired or more comfortable location along the backside of the user wearing the brassiere 100. When the brassiere 100 is worn by a user, the loop 206 may be positioned proximate to the backside of the neck of the user.

FIG. 2 further illustrates that the first strap 140 has an exterior surface 146 and an interior surface 210, while the second strap 150 also contains an exterior surface 156 and an interior surface 220. The exterior surfaces 146, 156 of the first and second straps 140, 150, respectively, are configured to face outward from the user wearing the brassiere 100. In other words, when the brassiere 100 is worn by the user, the exterior surface 146 of the first strap 140 and the exterior surface 156 of the second strap 150 are visible to others viewing the user wearing the brassiere 100. Conversely, when the brassiere 100 is worn by a user, the interior surface 210 of the first strap 140 and the interior surface 220 of the second strap 150 faces the user wearing the brassiere 100 and is configured to rest against or abut the body of the user wearing the brassiere 100. In one embodiment, the interior surfaces 210, 220 of the first and second straps 140, 150, respectively, may be constructed from a material that is softer to the touch than the material from which the exterior surfaces 146, 156 of the straps 140, 150 are constructed. In yet another embodiment, the first and second straps 140, 150 may be constructed from a material that is resilient, enabling the straps 140, 150 to stretch, deform, and contour to the user's body.

Disposed on the interior surface 210 of the first strap 140 is a fastener 300. Fastener 300 may be in the form of a strap, strip, or band of material having a first end 302, a second end 304, and an intermediate portion 306 spanning between the first and the second ends 302, 304. First and second ends 302, 304 may be coupled or fastened to the interior surface 210 of the first strap 140 at a location intermediate the first end 142 and the second end 144 of the first strap 140. The first and second ends 302, 304 of the fastener 300 may be coupled to the interior surface 210 of the first strap 140 via any conventional means, including, but not limited to stitching, bonding, adhesives, etc. In a first or rested configuration, the intermediate portion 306 may be disposed adjacent to, or abutting, the interior surface 210 of the first strap 140. The fastener 300, however, may be manipulated to form a loop or opening 400 through which objects may be threaded or in which objects may be secured. The opening 400 may be defined by the intermediate portion 306 of the fastener 300 and the interior surface 210 of the first strap 140. The opening 400 may be formed when the intermediate portion 306 is manipulated to be spaced from the interior surface 210 of the first strap 140. Thus, in this second configuration, the intermediate portion 306 may be separated, or pulled away, from the interior surface 210 of the first strap 140 to create opening 400.

Figure 4:
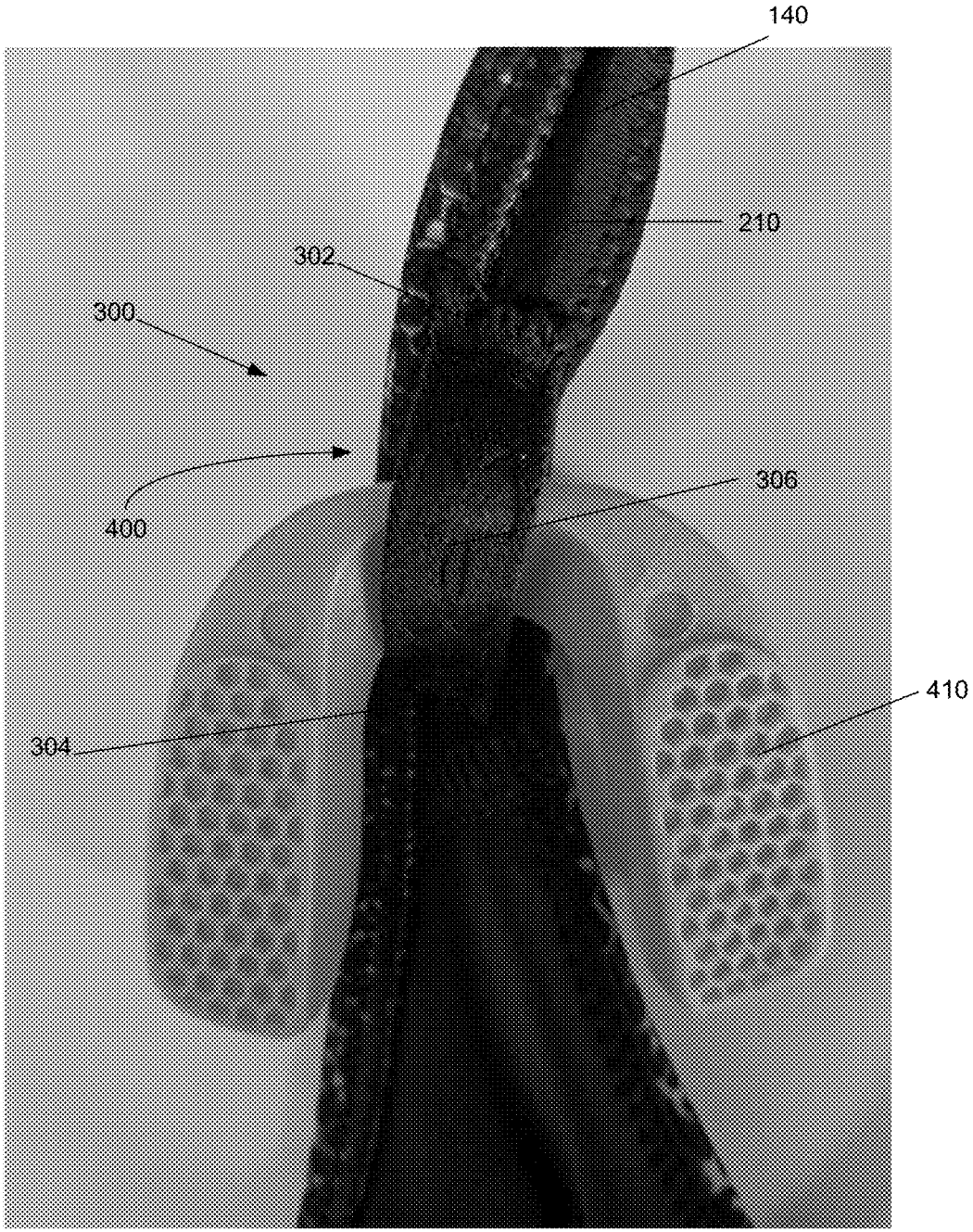
FIG. 4 illustrates a rear view of one of the straps of the embodiment of the brassiere illustrated in FIG. 1, where the strap is storing a mouth guard.

The fastener 300 may be constructed from a material that is resilient, enabling the fastener 300 to stretch and deform to impart a compression force on an object disposed within the fastener 300 (i.e., between the intermediate portion 306 and the interior surface 210 of the first strap 140). The compression force imparted by the resiliency of the fastener 300 onto an object threaded through the opening 400 of the fastener 300 secures the object within the opening 400. As illustrated in FIG. 4, a mouth guard or mouthpiece 410 is disposed within the fastener 300. The intermediate portion 306 of the fastener 300 is stretched and deformed around a portion of the mouth guard 410 to at least partially secure the mouth guard 410 to the first strap 140 of the brassiere 100. The intermediate portion 306 of the fastener 300 is configured to impart a force onto the object (e.g., mouth guard 410) to press or force the object against the interior surface 210 of the first strap 140.

In addition, the fastener 300 may be constructed from a material similar to that of the interior surface 210 of the first strap 140, such that the fastener 300 is also soft to the touch. Because the fastener 300 is disposed on the interior surface 210 of the first strap 140, the fastener 300 abuts or contacts the body of the user when wearing the brassiere 100. Thus, by constructing the fastener 300 from a material that is soft to the touch (i.e., a material similar to that of the interior surface 210 of the first strap 140), the first strap 140 remains comfortable to the user wearing the brassiere 100. This ensures that the fastener 300 does not cause any discomfort or irritation to the user wearing the brassiere 100.

While not illustrated, the second strap 150 may also include a fastener disposed on the interior surface 220 of the second strap 150. In another embodiment the fastener 300 may be disposed on the exterior surface 146 of the first strap 140 or the exterior surface 156 of the second strap 150.

Figure 5:
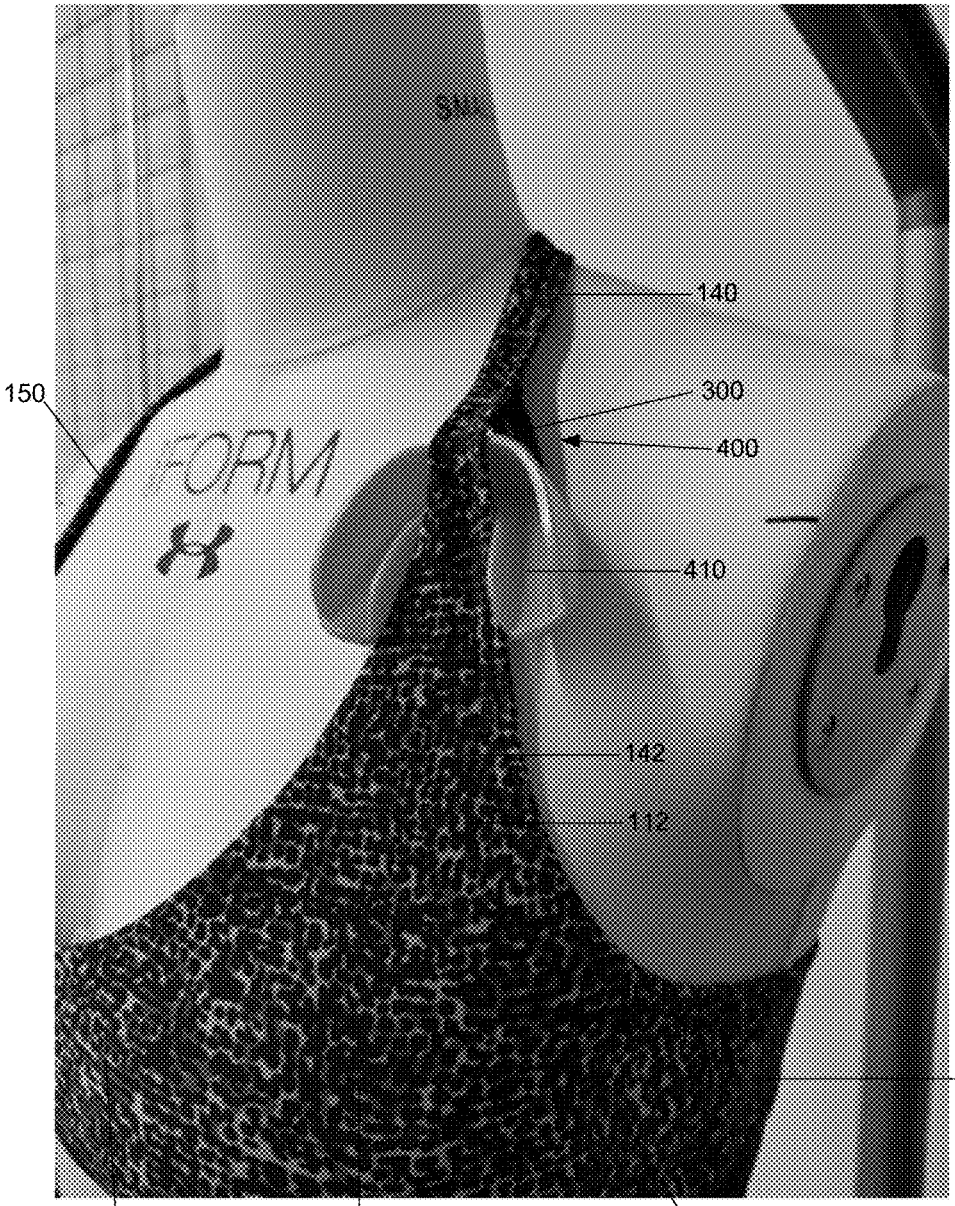
FIG. 5 illustrates a perspective view of the embodiment of the brassiere illustrated in FIG. 1, the brassiere storing a mouth guard in one of the straps while the brassiere is being worn.

The fastener 300 disposed on the first strap 140 of the brassiere 100 enables items or objects to be stored between activities (i.e., before and after workouts, during workout breaks, etc.) and also enable objects to be conveniently secured during workouts (i.e., securing the cord 182 of headphones 180). As illustrated in FIG. 5, the mouth guard 410 may be secured on the first strap 140 of the brassiere 100 by the fastener 300 while the brassiere 100 is worn by a user. The fastener 300 enables users to secure sporting items, such as a mouth guard 410, between uses (i.e., between plays, taking a water break, taking a snack break, talking to a teammate or other athlete, etc.) and in a location that is easily accessible. Securing items to the first strap 140 of the brassiere 100 may prevent items from getting lost in pockets or from being dropped while a user holds the items in their hand. In some instances, the other articles of clothing of the user wearing the brassiere 100 may not have any pockets. In these instances, the fastener 300 on the brassiere 100 enables items to be secured when not in use and without needing to be held in the hands of the user (i.e., freeing up the hands of the user). The location and resilient nature of the fastener 300 also enables the user to quickly secure items to the first strap 140 when the user's hands are needed or required.

Returning to FIG. 1, a set of headphones 180, which includes a cord 182 and a pair of earbuds 184, is threaded through the fastener 300 on the first strap 140. Threading the cord 182 of the headphones 180 through the opening 400 of the fastener 300 enables the headphones 180 to be secured to the brassiere 100 when the brassiere 100 is worn by a user. The earbuds 184 may be positioned proximate to or within a user's ears while the cord 182 is threaded through the opening 400 of the fastener 300. Threading the cord 182 of the headphones 180 through the fastener 300 while wearing the brassiere 100 serves several purposes. Firstly, the fastener 300 creates a point of restraint for the cord 182 on the brassiere 100. Thus, if the earbuds 184 fall out of the ears of the user wearing the brassiere 100, the earbuds 184 will hang from the fastener 300, and the user will be able to easily grasp the fallen earbuds 184 to reposition the earbuds 184 in the user's ear. The fastener 300 serving as a point of restraint on the brassiere 100 for the cord 182 also enables the user wearing the brassiere 100 to quickly remove the earbuds from the user's ear and let the earbuds hang from the fastener 300 to be able to hear sounds (e.g., talking to another person) and have free hands for other uses (e.g., throwing and catching a ball). Secondly, the fastener 300 secures the cord 182 of the headphones 180 close to the body of the user wearing the brassiere 100. This prevents the cord 182 from being caught by other objects or the user's arms and hands while the user performs activities. For example, when a user runs while wearing the brassiere 100 and has headphones 180 threaded through the fastener 300, the cord 182 of the headphones 180 is positioned close to the user's body, reducing the chance of being caught by the swinging arms of the user. Reducing the chance of the cord 182 of the headphones 180 being caught by other objects or the user's arms and hands prevents the cord 182 from being yanked, which reduces the chance the headphones 180 are pulled from the user's ears or from damaging the electronic device with which the cord 182 is connected (e.g., damaging the connector between the headphones and the device, dropping the device, etc.). The yanking of the headphone cord 182 is both annoying and dangerous to athletes performing activities.

As previously explained, the fastener 300 may be disposed on the interior surface 210 of the first strap 140, which abuts against the user's body when the brassiere 100 is worn. Thus, items secured or stored on the first strap 140 by the fastener 300 secured both by the resiliency of the fastener 300 and the resiliency of the first strap 140. While the fastener 300 imparts a force on the secured object to press or force the object against the interior surface 210 of the first strap 140, the resiliency of the first strap 140 also imparts a force on the object to press or force the object against the body of the user. This is best illustrated in FIGS. 1 and 5, where the cord 182 of the headphones 180 and the mouth guard 410 are pressed against the upper portion of the chest of the user wearing the brassiere 100 (i.e., just below the clavicle area of the user). The combination of the resiliency of the fastener 300 and the resiliency of the first strap 140, as described, ensures that objects disposed between the first strap 140 and the fastener 300 are secure during normal athletic movements. The resiliency of both the fastener 300 and the first strap 140, however, enables a user to both easily remove objects disposed between the fastener 300 and the first strap 140 and easily position objects between the fastener 300 and the first strap 140 for storage.

While the invention has been described in detail and with reference to specific embodiments thereof, it will be apparent to one skilled in the art that various changes and modifications can be made therein without departing from the spirit and scope thereof.

Thus, it is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A brassiere comprising:

at least one cup;

at least one shoulder strap having a distal end, a proximal end, an interior surface, and an exterior surface, the proximal end of the shoulder strap being coupled to the at least one cup, and the interior surface facing a user wearing the brassiere; and a strip including a first end, a second end, and an intermediate section disposed between the first end and the second end, the first and second ends being coupled to the interior surface of the at least one shoulder strap proximate to the at least one cup such that the strip is oriented along a chest of the user wearing the brassiere, the strip being configured to apply a compressive force to an object disposed between the strip and the at least one shoulder strap.

2. The brassiere of claim 1, wherein the strip has a first configuration, where the intermediate section abuts the interior surface of the at least one shoulder strap, and a second configuration, where the intermediate portion is spaced from the interior surface of the at least one shoulder strap to create an opening.

3. The brassiere of claim 2, wherein the opening is configured to receive and retain objects against the at least one shoulder strap.

4. The brassiere of claim 1, wherein the at least one shoulder strap is constructed from a resilient material.

5. The brassiere of claim 1, wherein the strip is constructed from a resilient material.

6. A brassiere comprising:

a first cup;

a second cup coupled to the first cup and laterally spaced from the first cup;

at least one shoulder strap coupled to the first and second cups, the at least one shoulder strap including an exterior surface and an interior surface, the interior surface facing a user when wearing the brassiere; and a strip including a first end, a second end, and an intermediate section disposed between the first end and the second end, the first and second ends being coupled to the interior surface of the at least one shoulder strap proximate to the first cup or the second cup such that the strip is oriented along a chest of the user wearing the brassiere, the strip being configured to apply a compressive force to an object disposed between the strip and the at least one shoulder strap.

7. The brassiere of claim 6, wherein the strip has a first configuration, where the intermediate section abuts the interior surface of the at least one shoulder strap, and a second configuration, where the intermediate portion is spaced from the interior surface of the at least one shoulder strap to create an opening.

8. The brassiere of claim 7, wherein the opening is configured to receive and retain objects against the at least one shoulder strap.

9. The brassiere of claim 6, wherein the first end and the second end of the strip are stitched to the interior surface of the at least one shoulder strap.

10. The brassiere of claim 6, wherein the strip is coupled to the interior surface of the at least one shoulder strap proximate to the first cup.

11. The brassiere of claim 6, wherein the at least one shoulder strap is constructed from a resilient material.

12. The brassiere of claim 6, wherein the strip is constructed from a resilient material.

13. The brassiere of claim 1, wherein the at least one shoulder strap further comprises:

a first edge spanning between the distal end and the proximal end; and a second edge opposite the first edge, the second edge spanning between the distal end and the proximal end, wherein the strip is disposed between the first end second edges of the shoulder strap.

14. The brassiere of claim 1, wherein the at least shoulder strap has a first length and the strip has a second length, the second length being aligned with the first length.

15. The brassiere of claim 6, wherein the at least one shoulder strap further comprises:

a first edge spanning between the first cup and the second cup; and a second edge opposite the first edge, the second edge spanning between the first cup and the second cup, wherein the strip is disposed between the first end second edges of the shoulder strap.

16. The brassiere of claim 6, wherein the at least shoulder strap has a first length and the strip has a second length, the second length being aligned with the first length.

17. The brassiere of claim 13, wherein the strip further comprises:

a third edge spanning between the first end and the second end; and a fourth edge opposite the third edge, the fourth edge spanning between the first end and the second end, wherein the third edge of the strip is aligned with the first edge of the at least one strap, and the fourth edge of the strip is aligned with the second edge of the at least one shoulder strap.

18. The brassiere of claim 15, wherein the strip further comprises:

a third edge spanning between the first end and the second end; and a fourth edge opposite the third edge, the fourth edge spanning between the first end and the second end, wherein the third and fourth edges of the strip are disposed between the first and second edges of the at least one strap.

* * * * *